US009079096B2

(12) United States Patent
Chen

(10) Patent No.: US 9,079,096 B2
(45) Date of Patent: Jul. 14, 2015

(54) INLINE ROLLER SKATE

(76) Inventor: Chih-Hsiang Chen, Guangdong (CN)

( * ) Notice: Subject to any disclaimer, the term of this patent is extended or adjusted under 35 U.S.C. 154(b) by 424 days.

(21) Appl. No.: 13/208,364

(22) Filed: Aug. 12, 2011

(65) Prior Publication Data

US 2012/0038121 A1 Feb. 16, 2012

(30) Foreign Application Priority Data

Aug. 13, 2010 (CN) ..... 2010 2 0291806 U

(51) Int. Cl.

| | |
|---|---|
| ***A63C 17/02*** | (2006.01) |
| ***A63C 17/04*** | (2006.01) |
| ***A63C 1/00*** | (2006.01) |
| ***A63C 17/00*** | (2006.01) |

(52) U.S. Cl.

CPC ..... *A63C 17/0033* (2013.01)

(58) Field of Classification Search

CPC ..... A63C 1/00; A63C 17/00; A63C 17/0066; A63C 17/06; A63C 17/22; A63C 17/0033

USPC ..... 280/11.223, 841, 11.221, 11.233, 280/11.19, 11.25, 11.27, 11.28

See application file for complete search history.

(56) References Cited

U.S. PATENT DOCUMENTS

| | | | | | |
|---|---|---|---|---|---|
| 1,034,649 | A * | 8/1912 | Rice | 280/11.223 |
| 2,204,280 | A * | 6/1940 | Meister | 280/11.223 |
| 2,719,723 | A * | 10/1955 | Ware | 280/11.209 |
| 3,046,032 | A * | 7/1962 | Humphries | 280/11.19 |
| 3,649,038 | A * | 3/1972 | Huckenbeck | 280/11.28 |
| 3,904,215 | A * | 9/1975 | Bardy | 280/11.212 |
| 3,936,061 | A * | 2/1976 | Wada | 280/11.226 |
| 4,034,995 | A * | 7/1977 | Forward et al. | 280/843 |
| 4,132,425 | A * | 1/1979 | Lehner et al. | 280/11.233 |
| 4,373,736 | A * | 2/1983 | Stumbaugh | 280/11.233 |
| 4,844,492 | A * | 7/1989 | Ludwig | 280/11.227 |
| 6,098,997 | A * | 8/2000 | Cheng | 280/11.28 |
| 6,227,551 | B1 * | 5/2001 | Roy | 280/11.223 |
| 6,439,584 | B1 * | 8/2002 | Lai | 280/11.27 |
| 6,497,421 | B1 * | 12/2002 | Edgerley et al. | 280/11.19 |
| 6,913,269 | B2 * | 7/2005 | Wang | 280/11.225 |
| 7,303,196 | B2 * | 12/2007 | Harper | 280/11.28 |
| 7,306,240 | B2 * | 12/2007 | Chen | 280/11.27 |
| 7,341,262 | B2 * | 3/2008 | Liu | 280/11.28 |
| 7,621,541 | B2 * | 11/2009 | Perkovich | 280/11.231 |
| 2008/0012249 | A1 * | 1/2008 | von Detten | 280/11.27 |

* cited by examiner

*Primary Examiner* — J. Allen Shriver, II
*Assistant Examiner* — James M Dolak

(57) ABSTRACT

An inline roller skate includes at least one eccentric inline roller assembly (7) mounted under boot sole (50). The eccentric inline roller assembly comprises an inclined base (70) and a roller unit (8). A central axis Y-Y of the inclined base is offset by an acute angle from a vertical axis H-H of travelling surface. The roller unit comprises a roller seat (80) and a roller (9). The roller seat is rotatably pivoted to the inclined base, and the roller is rotatably pivoted to the roller seat and drifts from the central axis Y-Y of the inclined base. The inline roller skate of the invention can be easily propelled and favorably make a turn.

15 Claims, 8 Drawing Sheets

INLINE ROLLER SKATE

BACKGROUND OF THE INVENTION

The present invention relates to an inline roller skate, and especially to an inline roller skate easily steering, changing traveling direction or making a turn.

Referring to FIGS. 1-2, the inline roller skate in the prior art comprises frame 10 and a plurality of inline rollers 11 serially arranged under the frame. The rollers 11 are parallel mounted to the frame 10 via shafts 12 coupled with bearings 13. Boot sole 20 is fixed on top of the frame 10 and under boot 30 for receiving foot of the skater. The rollers 11 of the inline roller skate in the prior can only run front and back, then, when the skater makes a turn, he shall making the rollers side slipping, which will require a considerable degree of skill, force and a good feeling of equilibrium, and will impact on flexibility and safety. Specially as traveling on slope or uneven ground surface, accident will be more possible. Furthermore, frequent side-slipping will cause rollers side wearing, which will reduce the duration of use. Moreover, the rollers of the prior roller skate is vertically arranged relative to the ground surface and parallel to axis of the skate, therefore, at the beginning of skating, the skater shall continually swing his arms or body for getting side slipping and propelling the roller, the skater easily feel short of force, and difficultly accelerating. In other words, the configuration of the prior inline roller skate causes a lower propelling force and lower speed for starting, uneasily turning, and unfavorably side slipping.

Therefore, an improved inline roller skate is desired which overcomes the disadvantages of the prior art.

BRIEF SUMMARY OF THE INVENTION

A main object of the present invention is to provide an inline roller skate, which can be easily propelled and favorably make a turn.

To obtain the above object, an inline roller skate in the invention comprises at least one eccentric inline roller assembly mounted under boot sole. The eccentric inline roller assembly comprises an inclined base and a roller unit. A central axis Y-Y of the inclined base is offset by an acute angle from a vertical axis H-H of travelling surface. The roller unit comprises a roller seat and a roller. The roller seat is rotatably pivoted to the inclined base, and the roller is rotatably pivoted to the roller seat and drifts from the central axis Y-Y of the inclined base.

Preferably, a frame is set under the boot sole, and the eccentric inline roller assembly is mounted to the frame via the frame forming the inclined base therein. The roller seat is pivoted to the inclined base via a main shaft. A locking pin is inserted in one end of the main shaft for rotatably fixing the roller seat to the inclined base.

The inclined base defines a first shaft hole therethrough with the central axis Y-Y; the roller seat correspondingly define a second shaft hole therethrough aligned to the first shaft hole, and a pair of shaft bearings are received in inner wall of the second shaft hole of the roller seat. Thereby the main shaft is inserted in the first and second shaft hole, and is engaged with the shaft bearings.

The inclined base extends downwards to form a projecting tab; the roller seat defines an annular groove on an top end thereof for receiving the projecting tab sliding therein; and offsetting spring is placed in the annular groove. Preferably, a stop block is set in the annular groove opposite to the projecting tab in an original position, thereby the annular groove is divided into two halves for respectively receiving one offsetting spring therein.

A pair of wheel forks rearwards and downwards extends from the roller seat, and the roller is pivoted to the wheel forks therebetween via an axle. A fixing pin is inserted in an end of the axle for rotatably fixing the roller to the wheel forks.

The inclined base and the roller seat substantially has a cylindrical or annular shape respectively defined the shaft hole in center.

The inline roller skate further comprises a brake extending downwards and rearward from a rear of the roller skate. Therefore, the skate will be stopped if desired.

The inline inclined base defines a first fixing hole therethrough, the roller seat defines a second fixing hole therein aligned to the first fixing hole; thereby, a fixing member inserts into the first and second fixing holes, and releasably secures the roller seat to the inclined base so as to limit a rotary movement therebetween. Thereby, the roller skate performs as inliners.

The inline roller skate comprises two eccentric inline roller assemblies linearly and serially mounted under boot sole.

Further to obtain the above object, an inline roller skate comprises a boot, a boot sole under the boot, a frame is fixed under the boot sole, and two sets of roller units eccentrically and rotatably pivoted at a front end and rear end of the frame via main shafts. A central axis Y-Y of the roller unit and the main shaft is offset by an acute angle relative to a vertical axis H-H of traveling surface. the roller unit comprises an eccentric roller seat and an inline roller. The eccentric roller seat is selectively rotatably pivoted to the front or rear end of the frame via the main shafts; the inline roller is rotatably pivoted to the eccentric roller seat via an axle so that the inline roller is positioned under the frame and offset from the central axis of the main shaft. Thereby the roller units briefly performs turning or changing travel direction via a rotation movement of the eccentric roller seat relative to the frame when a twisting force is exerted to the roller units, and the inline roller is propelled forwards which will provide an oblique forwards force for an easy travel or accelerating.

The frame respectively downwards inclines at front and rear ends thereof corresponding to the acute angel between the central axis and the vertical axis. The inclined front and rear ends respectively define an annular receptacle therein. The eccentric roller seat defines an annular shaft hole therethrough corresponding to the annular receptacle in the frame, whereby the main shaft engaged in the annular receptacle and shaft hole for rotatably mounting the roller seat to the front or rear end of the frame.

BRIEF DESCRIPTION OF THE DRAWINGS

Other objects, advantages and novel features of the invention will become more apparent from the following detailed description of a preferred embodiment thereof when taken in conjunction with the accompanying drawings, wherein.

DETAILED DESCRIPTION OF THE INVENTION

Figure 1:
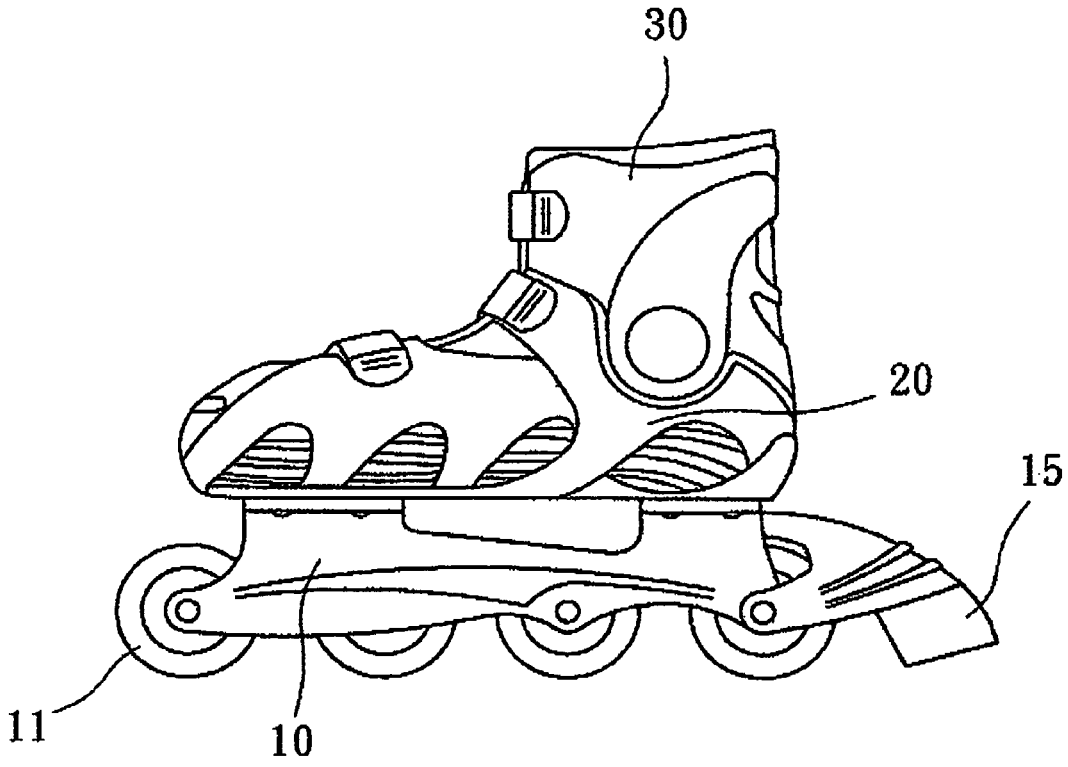
FIG. 1 (Prior Art)
FIG. 1 is a side view of an inline roller skate in the prior art.
Figure 2:
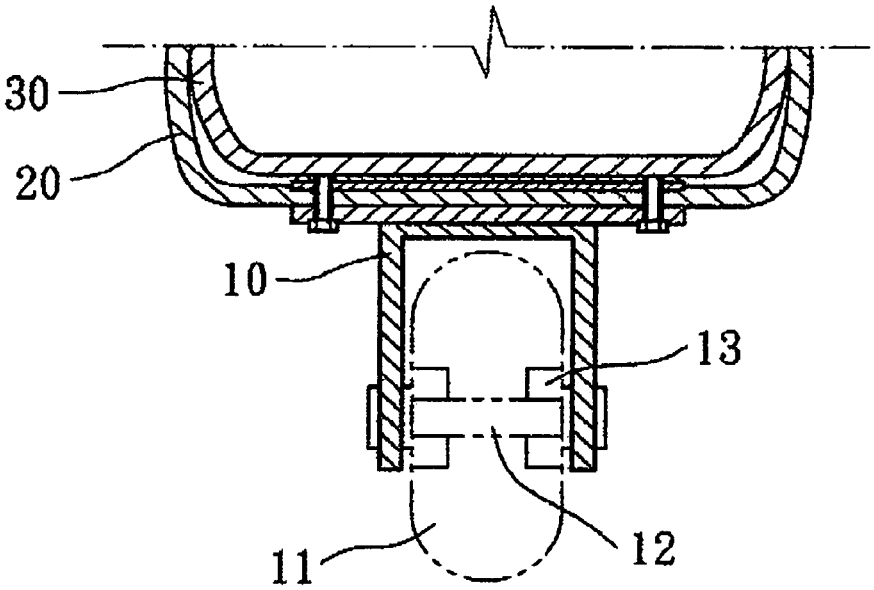
FIG.2 (Prior Art)
FIG. 2 is a partially, cross-section view of the inline roller skate in FIG. 1 in the prior art.
Figure 3:
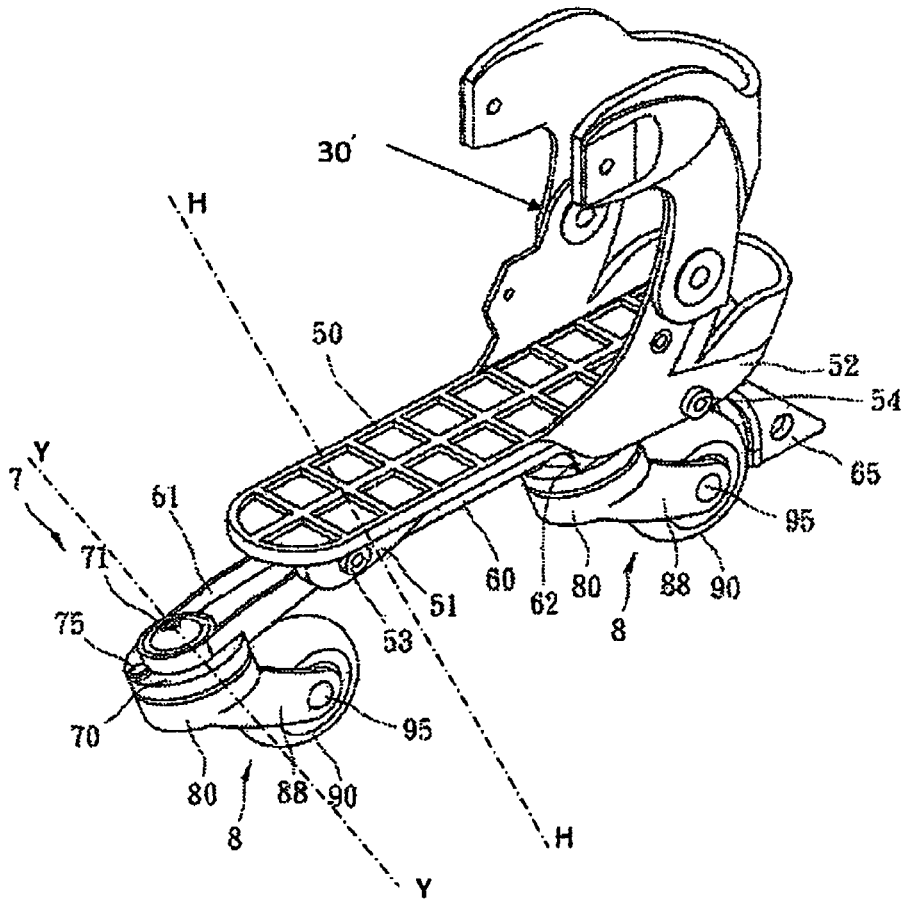
FIG. 3 is a perspective view of an inline roller skate in accordance with an embodiment of the invention.

Referring to FIG. 3, an inline roller skate according to the embodiment of the present invention includes a boot 30', boot sole frame 50, and at least one eccentric inline roller assembly 7 mounted under the boot sole frame 50.

Figure 4:
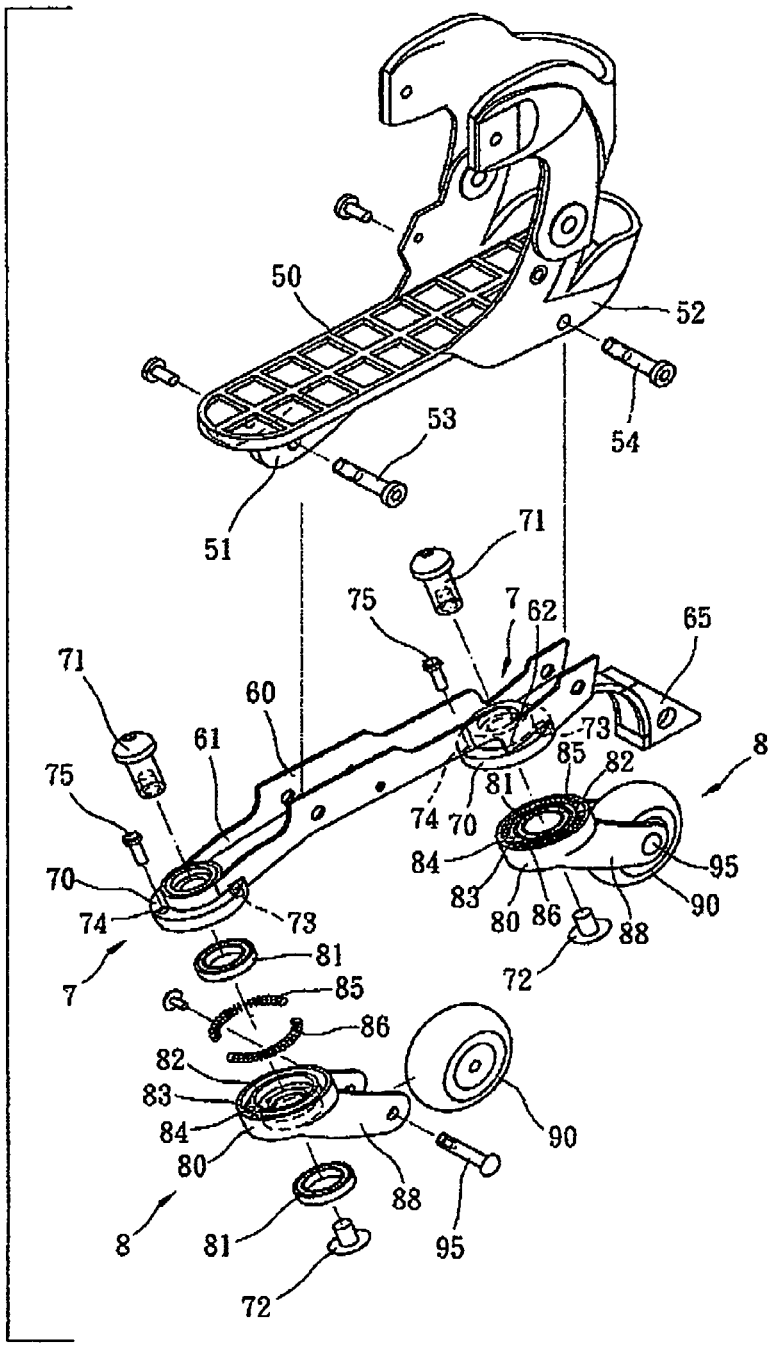
FIG. 4 is an exploded view of the inline roller skate in FIG. 3.
Figure 5:
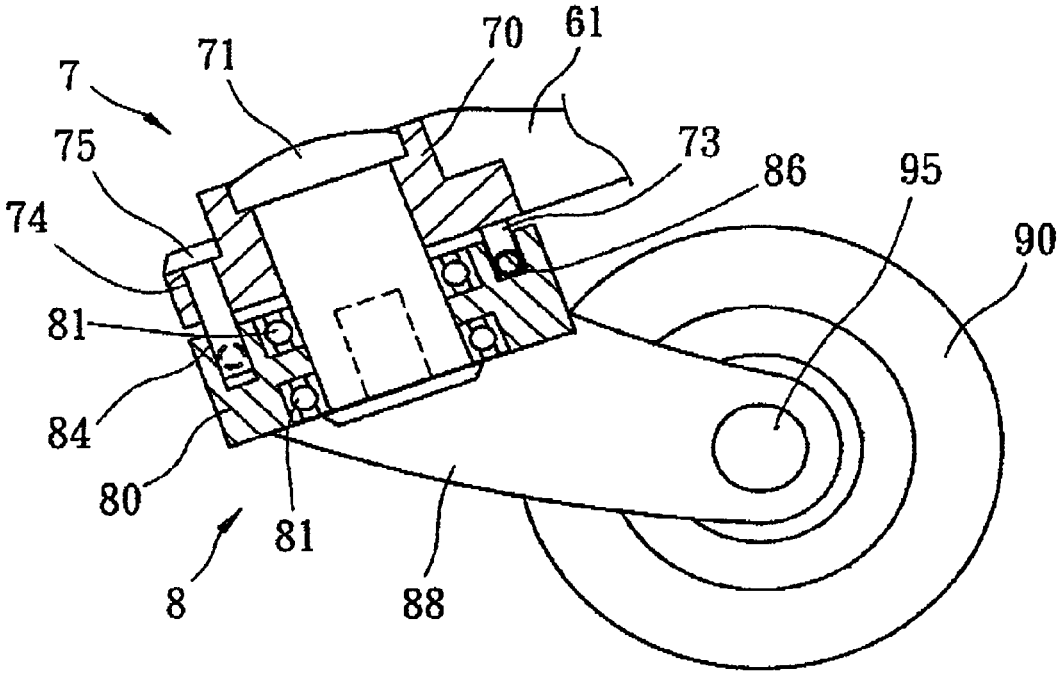
FIG. 5 is a partially, cross-section view of a roller assembly in FIG. 3.

In the preferable embodiment as shown in FIGS. 3-5, a frame 60 is set under the boot sole frame 50, and two eccentric inline roller assembly 7 are linearly and serially installed to the frame 60. The boot sole frame 50 sets at least one brace for fixing the frame 60 thereto, and preferably a front brace 51 is set under the boot sole frame 50 and a rear brace 52 is set at side of or under the boot sole frame. 50 for fixing the frame 60 via locking pins or bolts 53, 54. The frame 60 comprises a front frame 61 and a rear frame 62 respectively fixing one roller assembly 7 thereon.

From the boot sole frame 50 or the frame 62, a brake 65 extends downwards for stopping traveling if desired. Preferably, the brake 65 downwards extends from the rear of the frame 62.

The roller assembly 7 comprises an inclined base 70 and roller unit 8. Herein, the inclined base 70 can be formed on the braces 51, 52 or on the frame 60. Preferably, the front frame 61 and rear frame 62 respectively form an inclined base 70 thereon. The inclined base 70 substantially has a cylindrical or annular shape which defines an shaft hole 77 or shaft receptacle therethrough, and the roller unit 8 is rotatably mounted to the inclined base 70 via a main shaft 71 with a central axis Y-Y. The main shaft 71 is inserted in the inclined base 70 with one enlarged end abutting on top flange of the annular inclined base 70 and the other end extending into the cylindrical roller seat 80.

A central axis Y-Y of the eccentric inline roller assembly 7 is offset by an acute angle relative to a vertical axes H-H of the boot sole frame 50 or travelling surface. The roller unit 8 is coaxially pivoted to the inclined base 70 so that the roller unit 8 is eccentric or offset from the vertical axes H-H as well. The inclined base 70 at a bottom thereof downwards projects a tab 73 for guiding the rotation movement of the roller unit 8 with respect to the inclined base 70. A fixing hole 74 is defined through the inclined base 70 parallel to the main shaft 71.

The roller unit 8 comprises an incline roller 90 and a roller seat 80 substantially in a shape of cylinder corresponding to the inclined base 70. The roller seat 80 defines a fixing hole 84 aligned with the fixing hole 74 in the inclined base 70. Therefore, a fixing member 75 such as a pin, bolt, or shaft, is removably inserted in the fixing holes 74, 84 so that the rotation movement of the roller unit 8 with respect to the inclined base 70 is limited.

Figure 6:
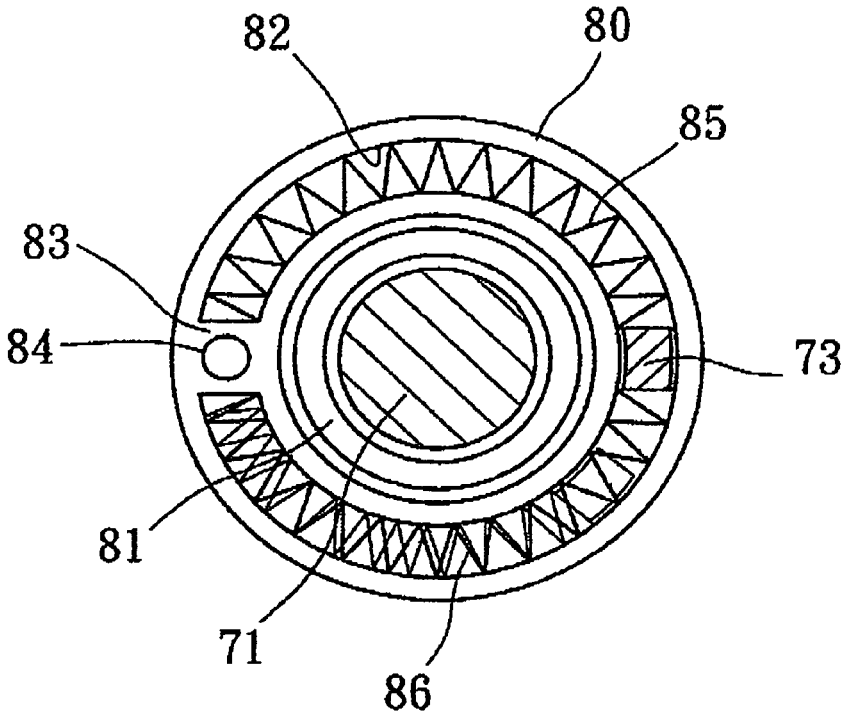
FIG. 6 is another cross-section view of roller assembly in FIG. 3.

Referring to FIGS. 5-6 together, the roller seat 80 defines a shaft hole 87 aligned to the shaft hole 77 of the inclined base 70. A top end of the cylindrical seat 80 defines an annular groove 82 for guiding the projecting tab 73 moving therein, and a stop block 83 is set in the annular groove 82. The fixing hole 84 is defined in the stop block 83. In an original position, the projecting tab 73 is located in the annular groove 82 opposite to the stop block 83 so as to divide the annular groove 82 into two halves for respectively receiving offsetting springs 85, 86 or any other restoring elastic element therein. The offsetting springs 85, 86 are pressed by the moving tab 73 to form a twisting force to urge the rotation movement of the roller unit 8 relative to the inclined base 70. On the other hand, the pressed offsetting springs 85,86 will bias the roller seat 80 moving to the original position relative to the incline base 70 after the twisting force disappears. Receiving grooves are defined in the inner wall of shaft hole 87 through the cylindrical seat 80.

A pair of wheel forks 88 eccentrically extend rearwards from the roller seat 80. The roller 90 is rotatably pivoted between the forks 88 via an axle 95, and a lock pin is inserted in an end of the axle 95 for further fixing axle 95 to the wheel forks 88.

The roller unit 8 further comprises a pair of shaft bearings 81 respectively accommodated in the receiving grooves in the inner wall of the roller seat 80. The main shaft 71 is inserted into the shaft holes 77, 87 and is engaged with the shaft bearings 81 in the cylindrical roller seat 80 so that the roller seat 80 is fixed to inclined base 70, and can rotate around the main shaft 71 relative to the inclined base 70 with the projecting tab 73 moving in the annual groove 82. The main shaft 71, inclined base 70, and roller seat 80 are coaxially assemblied about the central axis Y-Y, thus the roller seat 80 and inclined base 70 are eccentric from the vertical axis H-H of travelling surface. A locking pin 72 is inserted into an end of the main shaft 71 in the shaft hole 87 so as to further fixing the roller unit 8 to inclined base 70.

The fixing member 75 is inserted into the aligned fixing holes 74, 84 so as to fix the roller seat 80 to the inclined base 70 without rotation, the inline roller skate can perform a linear travel as a simple operation. If the fixing member is removed therefrom, the roller seat 80 can eccentrically rotate with respect to the inclined base 70 and offset from the vertical axis H-H, and the roller 90 and eccentrically rotate and offset from the central axis Y-Y. Since the roller unit 8 is eccentrically pivoted to the inclined base 70 via the main shaft 71, and the roller 90 is rearwards offset relative to the central axis Y-Y of the roller unit 8, when the inline roller skate travel forwards, the eccentric inline roller assembly 7 will produce a lateral force to propel the roller 90 traveling.

Figure 7:
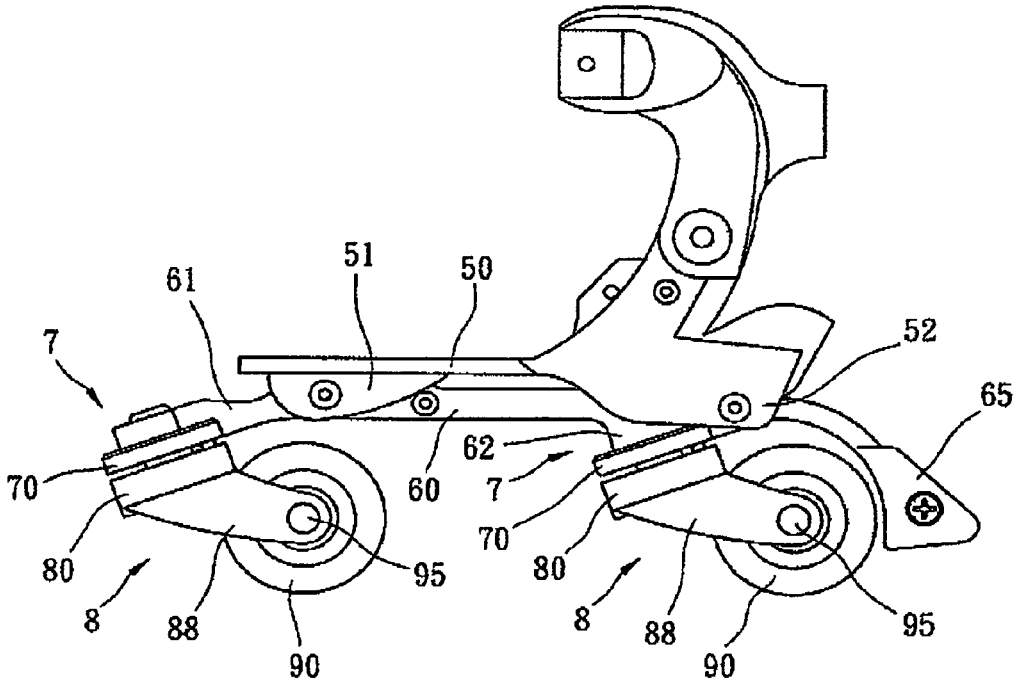
FIG. 7 is a perspective view of the inline roller skate in use in FIG. 3.

Referring to FIG. 7 together, in use, the skater puts his foot in the boot 30', removes the fixing member 75 from the eccentric inline roller assembly 7 such that the roller unit 8 can rotates freely relative to the inclined base 70. The roller 90 is pivoted to the wheel forks 88 which eccentrically extend rearwards from the roller seat 80, herein the roller 90 is offset from the central axis of the roller unit 8. The roller unit 8 is eccentrically pivoted to the frame 60 under the boot sole 50 via the inclined base 70, herein the central axis of the roller unit 8 is offset from the vertical axis H-H by an acuate angle. As a result, the roller 90 eccentrically extends rearwards so that the roller 90 travels forwards, which meanwhile will provide an oblique forwards force. Accordingly, less expenditure of force will be required and more powerfully propelling forward will be obtained.

By virtue of the rotary movement of the roller unit 8 with respect to the inclined base 70, the skater moves gravity center of body so as to compel the roller unit 8 rotating on the inclined base 70 and thus change the traveling direction of the roller skate. Herein, when the roller seat 80 turns around under a twisting force, the projecting tab 73 of the inclined base 70 slides in the annual groove 82 and compresses the offsetting springs 85,86, and when the twisting force disappears, the offsetting springs 85,86 will bias the roller seat 80 to the original position. Therefore, the traveling direction of the roller skate is easily changed.

Accordingly, the inline roller skate of the invention can easily turn travelling direction so that the skater can easily perform various and complicated motion, which brings more traveling enjoyment. Moreover, the roller unit 8 can provide an oblique forwards force, and the roller unit 8 can freely rotate under the boot sole frame 50, so that the roller skate can briefly, quickly and flexibly travel, even when pushing off and accelerating. Furthermore, the turning radius is relatively lower when the roller skate changes the travelling direction or makes a turn. Thereby, the roller skate can easily and briefly accelerate and changes the traveling direction anywhere even on slope, narrow or uneven traveling surface, and offers security to the skater.

Figure 8:
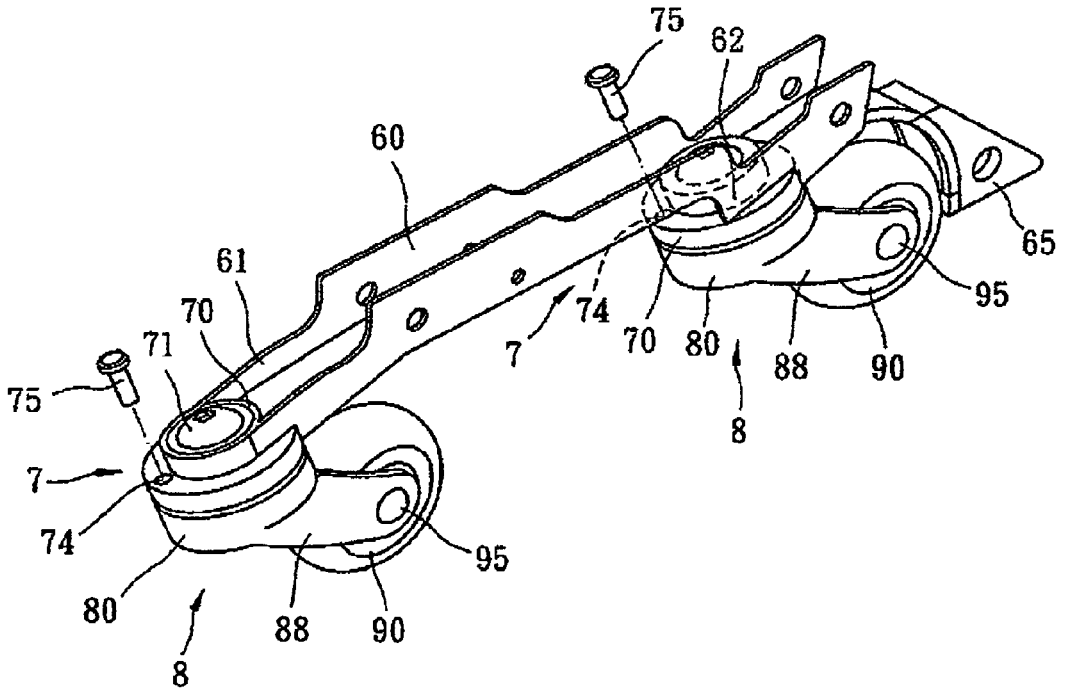
FIG. 8 is a partially, perspective view of the inline roller skate for an simple linear operation in FIG. 3.

Referring to FIGS. 3 and 8, when the fixing member 75 is inserted into the fixing holes 74, 84, the roller unit 8 is fixed to the inclined base 70 without rotary movement. Therefore, the eccentric inline roller assembly 7 is used as linear roller or inliners, which is very nice for the beginner. Herein, since the roller 90 is eccentric away from the central axis Y-Y, which will provide forwards propelling force as well.

It is understood that in the above description, such words about position or direction as "front", "rear", "top", "bottom", "forwards", "rearwards", "downwards", etc., are illustrative without limitation.

While the invention has been described in conjunction with specific embodiments, it is evident that numerous alternatives, modifications, and variations will be apparent to those skilled in the art in light of the forgoing descriptions. The scope of this invention is defined only by the following claims.

What is claimed is:

1. An inline roller skate comprising at least one eccentric inline roller assembly mounted under a boot sole frame, wherein the eccentric inline roller assembly comprises an inclined base and a roller unit, a central axis Y-Y of the inclined base is offset by an acute angle from a vertical axis H-H of the travelling surface; the roller unit comprises a roller seat and roller, the roller seat is rotatably and coaxially pivoted to the inclined base, and the roller is rotatably pivoted to the roller seat and offsets from the central axis Y-Y of the inclined base; wherein a frame is set under the boot sole frame, the inclined base is formed in the frame, and the eccentric inline roller assembly is mounted to the frame; the roller seat is pivoted to the inclined base via a main shaft; the inclined base defines a first shaft hole therethrough with the central axis Y-Y; the roller seat correspondingly defines a second shaft hole therethrough aligned to the first shaft hole, and a pair of shaft bearings are received in an inner wall of the second shaft hole of the roller seat; thereby the main shaft is inserted in the first and second shaft hole, and is engaged with the shaft bearings.

2. The inline roller skate according to claim 1, wherein a locking pin is inserted in one end of the main shaft for rotatably fixing the roller seat to the inclined base.

3. The inline roller skate according to claim 1, wherein the inclined base extends downwards to form a projecting tab; the roller seat defines an annular groove on a top end thereof for receiving the projecting tab sliding therein; and two offsetting springs are placed in the annular groove.

4. The inline roller skate according to claim 3, wherein a stop block is set in the annular groove opposite to the projecting tab in an original position, thereby the annular groove is divided into two halves for respectively receiving the offsetting springs therein.

5. The inline roller skate according to claim 1, wherein a pair of wheel forks rearwards and downwards extends from the roller seat, and the roller is pivoted to the wheel forks therebetween via an axle.

6. The inline roller skate according to claim 4, wherein a fixing pin is inserted in an end of the axle for rotatably fixing the roller to the wheel forks.

7. The inline roller skate according to claim 1, wherein the inclined base and the roller seat are substantially in a shape of cylinder.

8. The inline roller skate according to claim 1, further comprising a brake extending downwards and rearward from a rear of the roller skate.

9. The inline roller skate according to claim 1, wherein the inclined base defines a first fixing hole therethrough, the roller seat defines a second fixing hole therein aligned to the first fixing hole; thereby, a fixing member inserts into the first and second fixing holes, and releasably secures the roller seat to the inclined base so as to limit a rotary movement therebetween.

10. The inline roller skate according to claim 1, comprising two eccentric inline roller assemblies linearly and serially mounted under the boot sole frame.

11. An inline roller skate comprising: a boot; a boot sole frame under the boot; a frame is fixed under the boot sole frame; and two sets of roller units eccentrically and rotatably pivoted at a front end and rear end of the frame via main shafts; wherein a central axis of the roller unit and the main shaft is offset by an acute angle relative to a vertical axis of traveling surface; the roller unit comprises an eccentric roller seat and an inline roller; the eccentric roller seat is selectively rotatably pivoted to the front or rear end of the frame via the main shafts; the inline roller is rotatably pivoted to the eccentric roller seat via an axle so that the inline roller is positioned under the frame and offset from the central axis of the main shaft; whereby the roller units briefly performs turning or changing travel direction via a rotation movement of the eccentric roller seat relative to the frame when a twisting force is exerted to the roller units, and the inline roller is propelled forwards which will provide an oblique forwards force for an easy travel or accelerating.

12. The inline roller skate according to claim 11, wherein the roller units are releasably secured to the front and rear ends of the frame via an additional fixing member for limiting rotation movement of the roller units relative to the frame for a simple linear operation.

13. The inline roller skate according to claim 11, wherein the frame respectively downwardly inclines at front and rear ends thereof corresponding to the acute angle between the central axis and the vertical axis; the inclined front and rear ends respectively define an annular receptacle therein; the eccentric roller seat defines an annular shaft hole therethrough corresponding to the annular receptacle in the frame, whereby the main shaft engaged in the annular receptacle and shaft hole for rotatably mounting the roller seat to the front or rear end of the frame.

14. The inline roller skate according to claim 11, wherein the roller unit inclines and downwards extends to form a pair of wheel forks so as to pivot the wheel forks therebetween via the axle.

15. The inline roller skate according to claim 13, wherein the rotation movement of the eccentric roller seat relative to the frame is guided via a projecting tab sliding in an annular groove of the annular receptacle and the roller seat.

* * * * *